US010337205B2

(12) United States Patent
Westfahl

(10) Patent No.: US 10,337,205 B2
(45) Date of Patent: Jul. 2, 2019

(54) PORTABLE FENCE SYSTEM

(71) Applicant: Erick Westfahl, Yukon, OK (US)

(72) Inventor: Erick Westfahl, Yukon, OK (US)

( * ) Notice: Subject to any disclaimer, the term of this patent is extended or adjusted under 35 U.S.C. 154(b) by 0 days.

(21) Appl. No.: 16/014,497

(22) Filed: Jun. 21, 2018

(65) Prior Publication Data

US 2018/0371790 A1 Dec. 27, 2018

Related U.S. Application Data

(60) Provisional application No. 62/523,565, filed on Jun. 22, 2017.

(51) Int. Cl.
*E04H 17/20* (2006.01)
*E04H 17/16* (2006.01)
*E04H 17/14* (2006.01)

(52) U.S. Cl.
CPC ..... *E04H 17/20* (2013.01); *E04H 17/16* (2013.01); *E04H 2017/1491* (2013.01)

(58) Field of Classification Search
CPC ..... E04H 17/18; E04H 17/16; E04H 17/24; E04H 17/22; E04H 17/1434; E04H 17/1443; E04H 2017/146; E04H 17/08; E04H 12/2238; E01F 13/02; E01F 13/022; E01F 7/02; E01F 9/692; E01F 9/688; E04G 21/3238
USPC ..... 256/26, 31, 27, 28, 29, 30, DIG. 2
See application file for complete search history.

(56) References Cited

U.S. PATENT DOCUMENTS 62,209 A * 2/1867 King ..... E04H 17/22 52/150
65,372 A * 6/1867 Gibbs ..... E04H 17/16 256/31
255,673 A * 3/1882 Robinson et al. ..... E04H 17/16 256/31
281,028 A * 7/1883 Cox ..... E04H 17/16 256/31
321,978 A * 7/1885 Kemery ..... E04H 17/16 256/31
359,520 A * 3/1887 Rong ..... E04H 17/16 256/31
391,132 A * 10/1888 Fellows ..... E04H 17/16 256/31
402,729 A * 5/1889 Fellows ..... E04H 17/22 52/150
404,856 A * 6/1889 Ogilvie ..... E04H 17/18 256/26
798,567 A * 8/1905 Chiber ..... E04H 17/16 256/31
826,124 A * 7/1906 Soseman ..... E04H 17/22 126/30

(Continued)

FOREIGN PATENT DOCUMENTS

CA 2178827 A1 * 6/1995 ..... B09B 1/004
DE 202015106331 U1 * 12/2015 ..... E04H 17/18

(Continued)

*Primary Examiner* — Matthieu F Setliff
(74) *Attorney, Agent, or Firm* — Phillips Murrah PC; Martin G. Ozinga

(57) ABSTRACT

A relocatable security fence system that may comprise a fence panel system attached to posts with bases and adjustable braces adapted to be used during instances where it is prohibitive to install a fence system by bolting to the ground or otherwise damaging the ground.

1 Claim, 11 Drawing Sheets

(56) References Cited

U.S. PATENT DOCUMENTS 881,267 A * 3/1908 Titsworth ..... E04H 17/22 52/150
896,500 A * 8/1908 Wolfe et al. ..... E04H 17/22 256/35
942,592 A * 12/1909 Schneider ..... E04H 17/22 248/354.4
962,271 A * 6/1910 Thompson et al. .... E04H 17/22 254/100
991,913 A * 5/1911 Von Engeln ..... E04H 17/22 52/150
1,131,681 A * 3/1915 Demares ..... E04H 17/22 52/150
1,134,897 A * 4/1915 Novess ..... E04H 17/22 52/150
1,165,906 A * 12/1915 Rhoades ..... E01F 7/02 256/12.5
1,271,751 A * 7/1918 Novess ..... E04H 17/22 52/150
3,551,920 A * 1/1971 Greene ..... E04H 4/0062 256/26
3,630,491 A * 12/1971 Puccio ..... E01F 13/022 256/64
4,339,114 A * 7/1982 Deike ..... E01F 7/02 256/12.5
4,412,396 A * 11/1983 Silbernagel ..... G09F 7/18 40/606.11
4,799,642 A * 1/1989 Wright ..... H01Q 1/1221 248/237
4,909,483 A * 3/1990 van Herpen ..... E04G 21/3233 256/59
5,653,308 A * 8/1997 White ..... E04G 21/3233 182/138
5,842,685 A 12/1998 Purvis et al.
5,979,844 A 11/1999 Hopkins
6,406,002 B1 6/2002 Hardy, III et al.
6,730,817 B1 5/2004 Wilmet et al.
2004/0255544 A1 12/2004 Bradley
2016/0086525 A9 3/2016 White
2017/0009485 A1 1/2017 Gentry et al.
2017/0356203 A1* 12/2017 Nagel ..... E04G 21/32

FOREIGN PATENT DOCUMENTS

EP 0556415 A1 * 8/1993 ..... E01F 9/688
FR 2645186 A1 * 10/1990 ..... E01F 9/688
FR 2680529 B1 * 10/1993 ..... E01F 9/688
FR 3032987 A1 * 8/2016 ..... E04G 21/3228
FR 3032987 B1 * 3/2017 ..... E04G 21/3228
GB 1048439 A * 11/1966 ..... E04H 17/08
WO WO-9516842 A1 * 6/1995 ..... B09B 1/004

* cited by examiner

PORTABLE FENCE SYSTEM

CROSS-REFERENCE TO RELATED APPLICATIONS

Priority is claimed from provisional application U.S. Ser. No. 62/523,565 filed on Jun. 22, 2017, and incorporated by reference herein.

BACKGROUND OF THE INVENTION

1. Field of the Invention

In general, the present invention relates to an apparatus, system and method of providing a portable secure fence. More particularly, the present invention provides a robust high security fence system that may be utilized without damaging and or penetrating the ground, may also be used on unleveled surfaces, and requires no special tools or weights.

2. Description of the Prior Art

It is often desirable to provide security fencing in areas where it is undesirable to secure the fence by mounting into the ground where it is prohibitive to damaging the ground. By example, runways, parking lots, temporary secured sites, military positions and or museums may need secure fencing where it is undesirable to damage the ground for obvious reasons. In the prior art, temporary fencing is frequently used that requires weights such as sand bags to provide the stability to the fence at the base.

Unfortunately, these weights typically are not permanently positioned such that someone trying to breach the fence can move the weight and tip over the section of fence or just shove the fence over by toppling because the sand bags are not secured to the actual fence, but rather draped over a base section. Furthermore, the sand bags typically used must be heavy, require transportation, disposal and often break open, which obviously creates a further issue.

There are no identified systems in the prior art that allow for high security fencing to be installed in areas that do not allow for ground penetration. It is, therefore, desirable to provide a relocatable fence system that allows for higher security panels to be installed in locations unable to penetrate the ground such as runways, parking lots, temporary secured sites and military positions. Furthermore, it is desirable to provide the stability that allows for rackable metal picket fencing that adjust with the grade to provide adjustment in both directions for complete grade alteration.

The balance of cost, time, operational efficiency and security desired with fencing show a need for new and improved fence systems. The above discussed limitations in the prior art is not exhaustive. Thus, there is a need for an apparatus, method and system to provide secure fencing where it is prohibitive to mount into the ground other than the current methods. The current invention provides an inexpensive, time saving, more reliable apparatus, system and method where the prior art fails.

SUMMARY OF THE INVENTION

In view of the foregoing disadvantages inherent in the known types of portable fence systems now present in the prior art, the present invention provides a new and improved fence system apparatus, system and method of use, which may be utilized where it may be desirable to not attach and or damage the ground. As such, the general purpose of the present invention, which will be described subsequently in greater detail, is to provide a new and improved fence system, which has advantages of the prior art devices and none of the disadvantages.

To attain this, the present invention essentially comprises a fence system generally comprising a post system wherein a post is hingedly attached to a base and secured with a hinged brace between the post and the brace essentially forming a triangle. After the post system is deployed, fence panels may be secured to the post at the post top and bottom. A perimeter may be constructed utilizing same with gate members and hinge members. It is understood that fence system may be physically attached to the ground if desired by bolting to the ground.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in this application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception upon which this disclosure is based may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a new and improved fence system, which may be easily and efficiently erected without the need to damage the ground below it.

It is a further object of the present invention to provide a new and improved fence system, which is of a durable and reliable construction and may be utilized with multiple applications.

An even further object of the present invention is to provide a new and improved fence system, which is susceptible to a low cost of manufacture with regard to both materials and labor, and which accordingly is then susceptible to low prices of utilization those in need, thereby making such economically available to those in the field.

Still another object of the present invention is to provide a new and improved fence system, which provides all of the advantages of the prior art, while simultaneously overcoming some of the disadvantages normally associated therewith.

Another object of the present invention is to provide a new and improved fence system, which provides robust high security in areas not suited for ground penetration for securing a fence.

Yet another object of the present invention is to provide a new and improved fence system that may be erected and utilized on site with existing transportation equipment and no special tools.

An even further object of the present invention is to provide a new and improved fence system, which may accommodate grades and still provide upright posts and associated panels.

Still another object of the present invention is to provide a new and improved fence system, which may not require the addition of weights to hold the fence system in place.

Yet still another object of the present invention is to provide a new and improved fence system, which may be utilized with numerous types of fence panels and provides for multiple configurations that may include hinged gates.

Another object of the present invention is to provide a new and improved fence system, which provides relocatable fence that may be permanently installed to the ground if desired.

These, together with other objects of the invention, along with the various features of novelty, which characterize the invention, are pointed out with particularity in the claims annexed to and forming a part of this disclosure. For a better understanding of the invention, its operating advantages, and the specific objects attained by its uses, reference should be had to the accompanying drawings and descriptive matter in which there are illustrated preferred embodiments of the invention.

BRIEF DESCRIPTION OF THE PICTORIAL ILLUSTRATIONS, GRAPHS, DRAWINGS, AND APPENDICES

The invention will be better understood and objects other than those set forth above will become apparent when consideration is given to the following detailed description thereof. Such description makes reference to the annexed pictorial illustrations, graphs, drawings, and appendices.

DETAILED DESCRIPTION OF THE PREFERRED EMBODIMENTS

Figure 1:
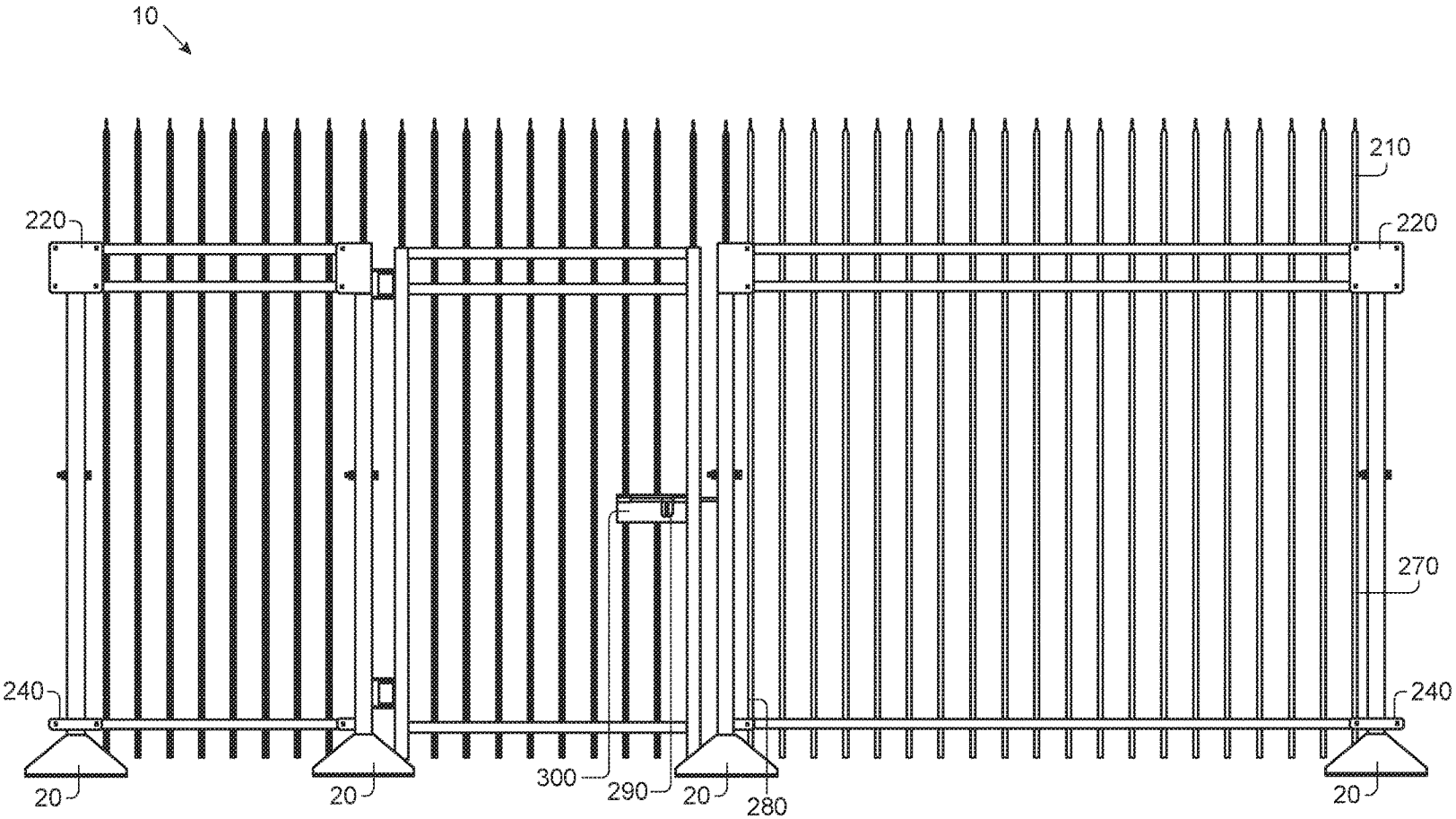
FIG. 1 is a general illustration of a preferred embodiment in accordance with the invention depicting a section of a completed fence.

Referring to the illustrations, drawings, and pictures and to FIG. 1 in particular, reference character 10 generally designates a new and improved fence apparatus, system and method of using same constructed in accordance with the present invention. Invention 10 is generally used where it is desirable to maintain a secure area with a fence and it is undesirable to damage the ground to secure the fence. It is understood that invention 10 may be utilized in numerous other applications where it is desirable to provide fencing and the current invention should not be considered limited to just non-ground attached applications Now referring more in particular to FIGS. 2-5, invention 10 may comprise a post system 20, which may include a base 30, a post 40, and a brace 50. It is contemplated that base 30 may provide post 40 and brace 50 to be folded into base 30 as described below.

Figure 2:
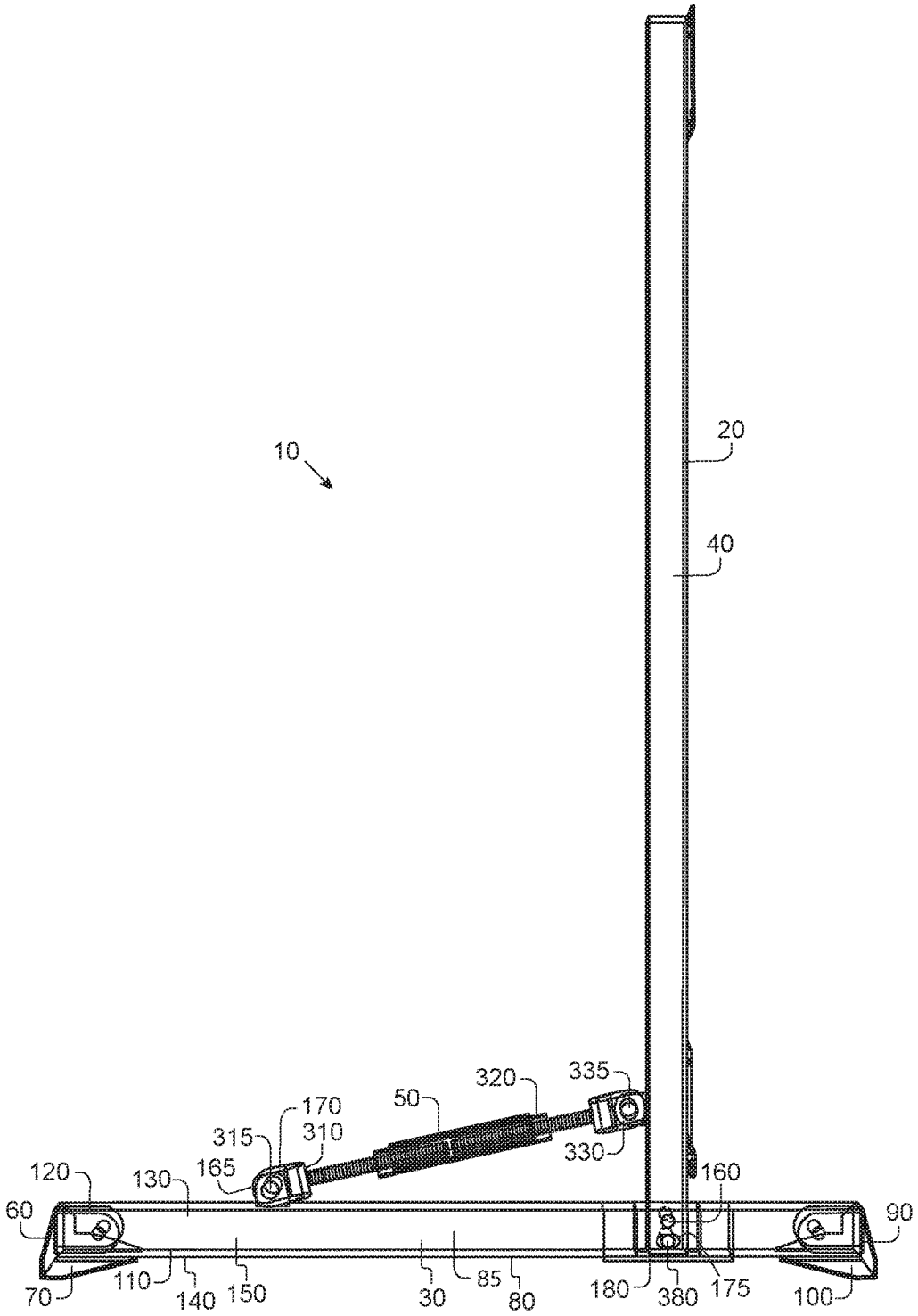
FIG. 2 is a general illustration of a preferred embodiment in accordance with the invention depicting a deployed post system.

Base 30 may have a first end 60 having a first stabilization plate and or footing 70, a length and or middle section 80 with a midpoint 85, a second end 90 having a second stabilization plate and or footing 100, a bottom 110, a top 120 with a cavity and or channel 130, a first side 140, a second side 150, a first hinge pivot 160, and a second hinge pivot 170. First hinge pivot 160 and second hinge pivot 170 may be removable bolts through respective apertures. It is contemplated that aperture 175 may be generally elliptical allowing set bolt 380 to move forward and or backward thereby allowing a degree of swing of post 40 thereby allowing post 40 to be angled as desired It is understood that base 30 may not have channel 130 and be made from a solid piece of metal, a tube, and so forth. It is also understood that second hinge pivot 170 may be ears 165 fixed on top 120 as generally depicted in FIG. 2. It is also contemplated that first hinge pivot 160 may also be located on top 120 although not depicted.

Referring to the illustrations and more in particular to FIGS. 6, 7, 8A-8F, 9 and 10, post 40 may have a bottom and or first end 180 that may be attached to base 30 first hinge pivot 160, a length and or middle section 190 with a midpoint 195, a top and or second end 200 with fence panel 210 first attachment or mounting bracket 220. Post 40 may also include a hinge point 230 for brace 50, which will be described in greater detail below. Post 40 may also include fence panel 210 second attachment or mounting bracket 240. It is understood that numerous brackets and locations of brackets on post 40 are contemplated and the invention is not limited to the illustrations.

It is also understood that post 40 may provide "corner" post 40 for assembling a secure area where the fence panel 210 mounting bracket 220 has a first section 250 for mounting one fence panel section 210 and a second section 260 at 90 degrees from first section 250 for attaching second fence panel 210. It is understood that a "corner," "line," "hinged gate," and "lock side gate post" are all made from post system 20 with some modifications, but all still may have base 30, post 40 and or brace 50 configuration as described above.

A "line" post 40 may have fence panel 210 mounting bracket 220 with first section 250 for mounting first fence panel 210 in the same plane as second section 260. It is understood numerous angles may be provided for attaching fence panels 210 to post 40. The current illustrations should not limit the invention to just "line" posts 40 and or "corner" post 40. It is contemplated to provide circular fence systems, oval, combinations and so forth wherein post 40 is utilized with a respective angle of mounting bracket 220 to provide the desired shape when fence panels 210 are attached to post 40.

Invention 10 further contemplates "hinged gate" post 40 wherein one or more hinged brackets 225 are attached to post 40 and respectively to fence panel 210 such that first end 270 fence panel 210 is hingedly fixed to post 40 and second end 280 of fence panel section 210 is allowed to swing. Post 40 may utilize non-hinged bracket 220 wherein fence panel 210 may include a hinged segment. It is also contemplated that post 40 may have a portion of a hinge and fence panel 210 has the corresponding connection portion of the hinge. Fence panel 210 second end 280 may be provided with securing device 290 for communicating with latch and or lock 300 and so forth.

Invention 10 also contemplates a "lock side gate" post 40 may have a locking lug mated to the locking plate located on the panel. The "double-drive gates" may have a "lock side gate" post 40 that receives both gate panels and is removed from the drive.

Brace 50 may have a first end 310 for securing pivotally to base 30 with pivot 315, an adjustable length 320, and a second end 330 hinged and or attached to post 40 with pivot 335. Adjustable length 320 may include turnbuckle 340 that may allow for post 40 to be plumbed vertically and or sloped in either direction as determined by lengthening and or shortening brace 50 adjustable length 320. It is understood that turning brace 50 a first direction 345 may shorten length 320 and turning brace a second direction 355 may make length 320 longer.

Figure 5:
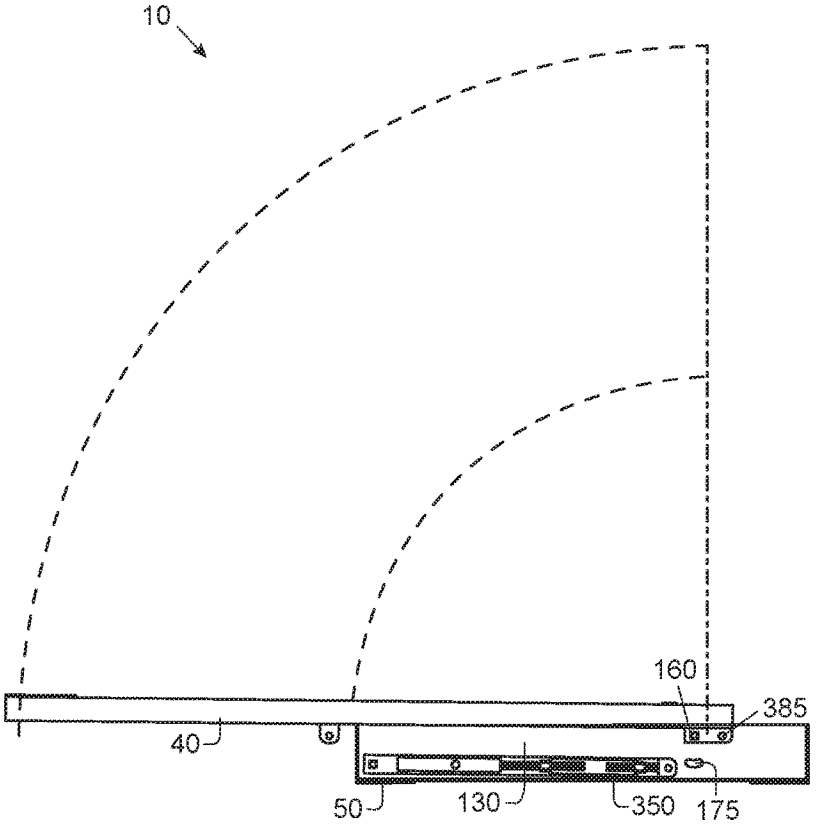
FIG. 5 is a general illustration of a preferred embodiment in accordance with the invention depicting the post system in a non-deployed position.
Figure 4:
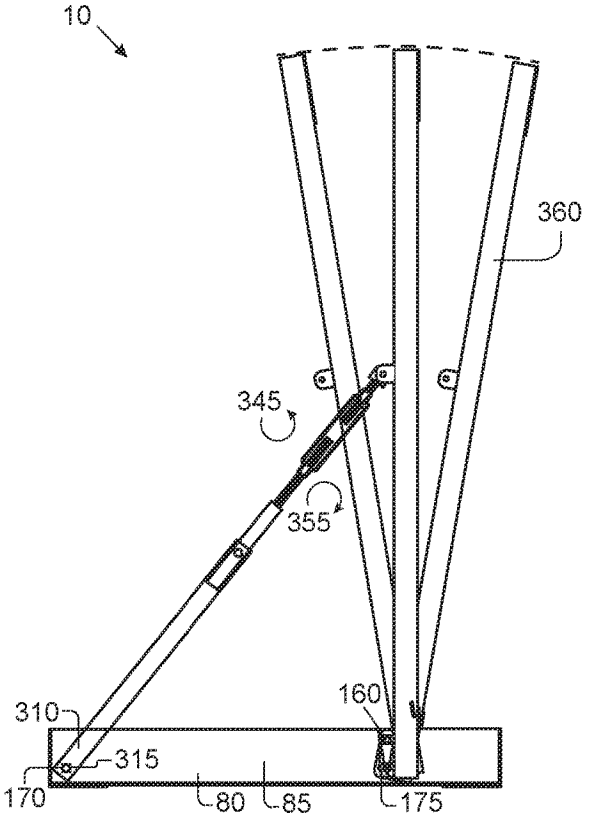
FIG. 4 is a general illustration of a preferred embodiment in accordance with the invention depicting the post being deployed and a range of motion for the deployment of the post.
Figure 6:
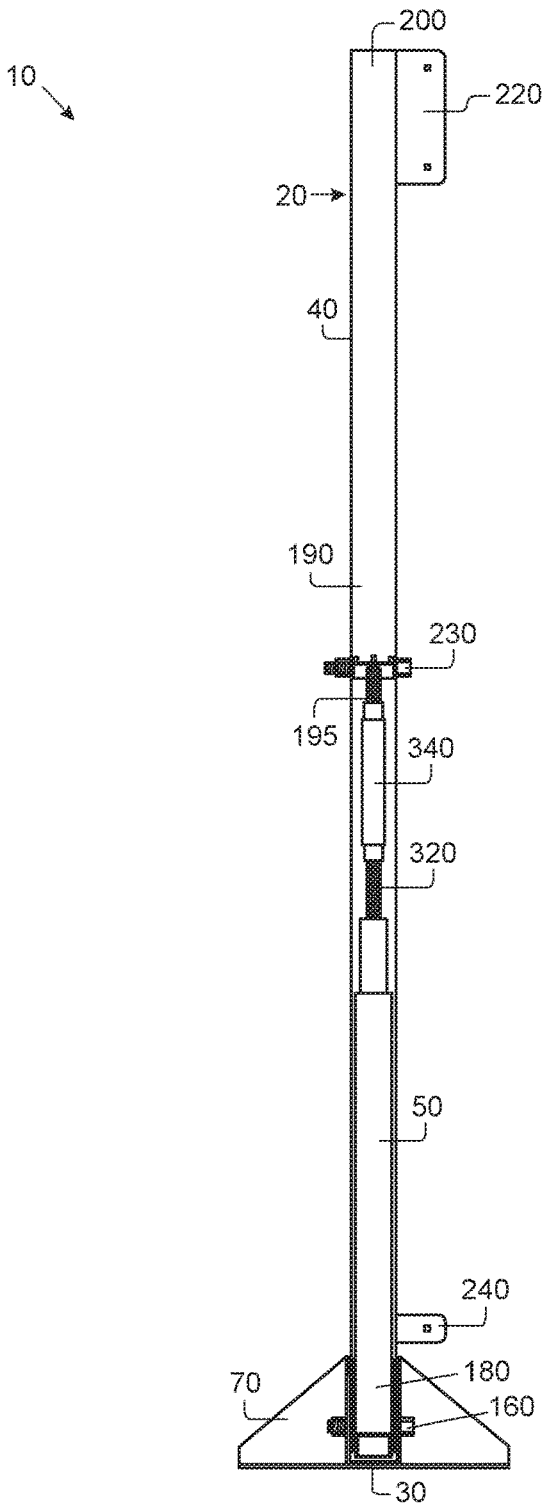
FIG. 6 is a general illustration of a preferred embodiment in accordance with the invention depicting a post system.
Figure 7:
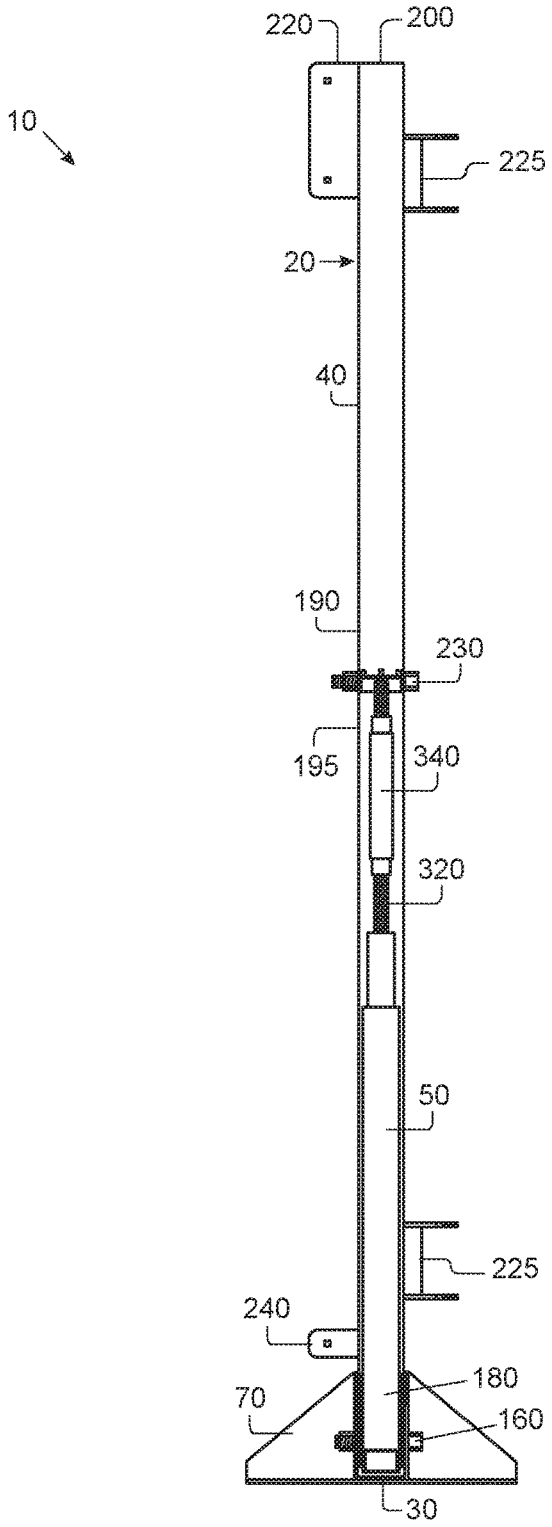
FIG. 7 is a general illustration of a preferred embodiment in accordance with the invention depicting a post system with hinges.
Figures 8A, 8B, 8C, 8D, 8E, 8F:
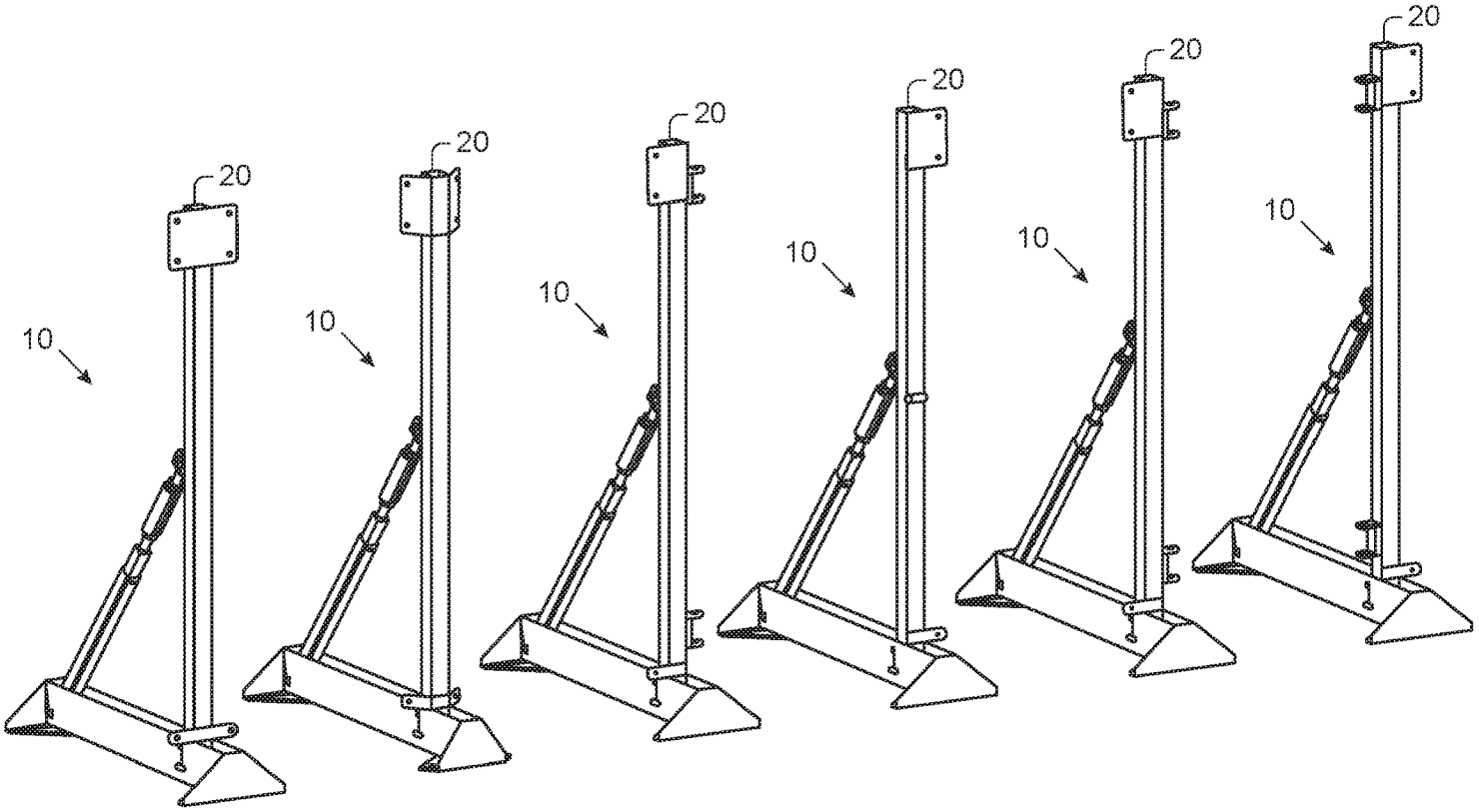
FIGS. 8A-8F are general illustrations of preferred embodiments in accordance with the invention depicting different bracketing systems for attaching fence sections.
Figure 9:
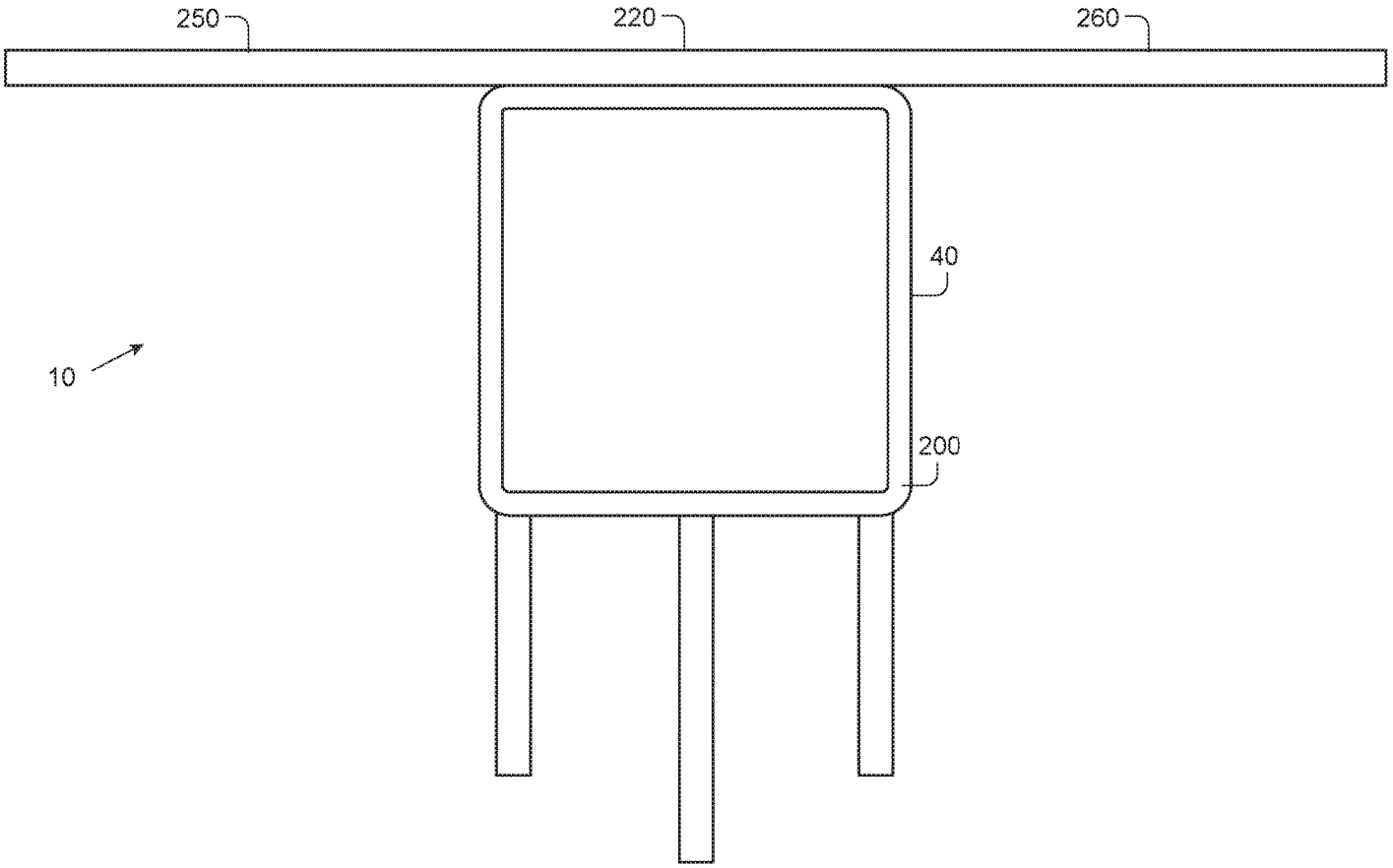
FIG. 9 is a general pictorial illustration of a preferred embodiment in accordance with the invention depicting a top of a post and a bracket.
Figure 10:
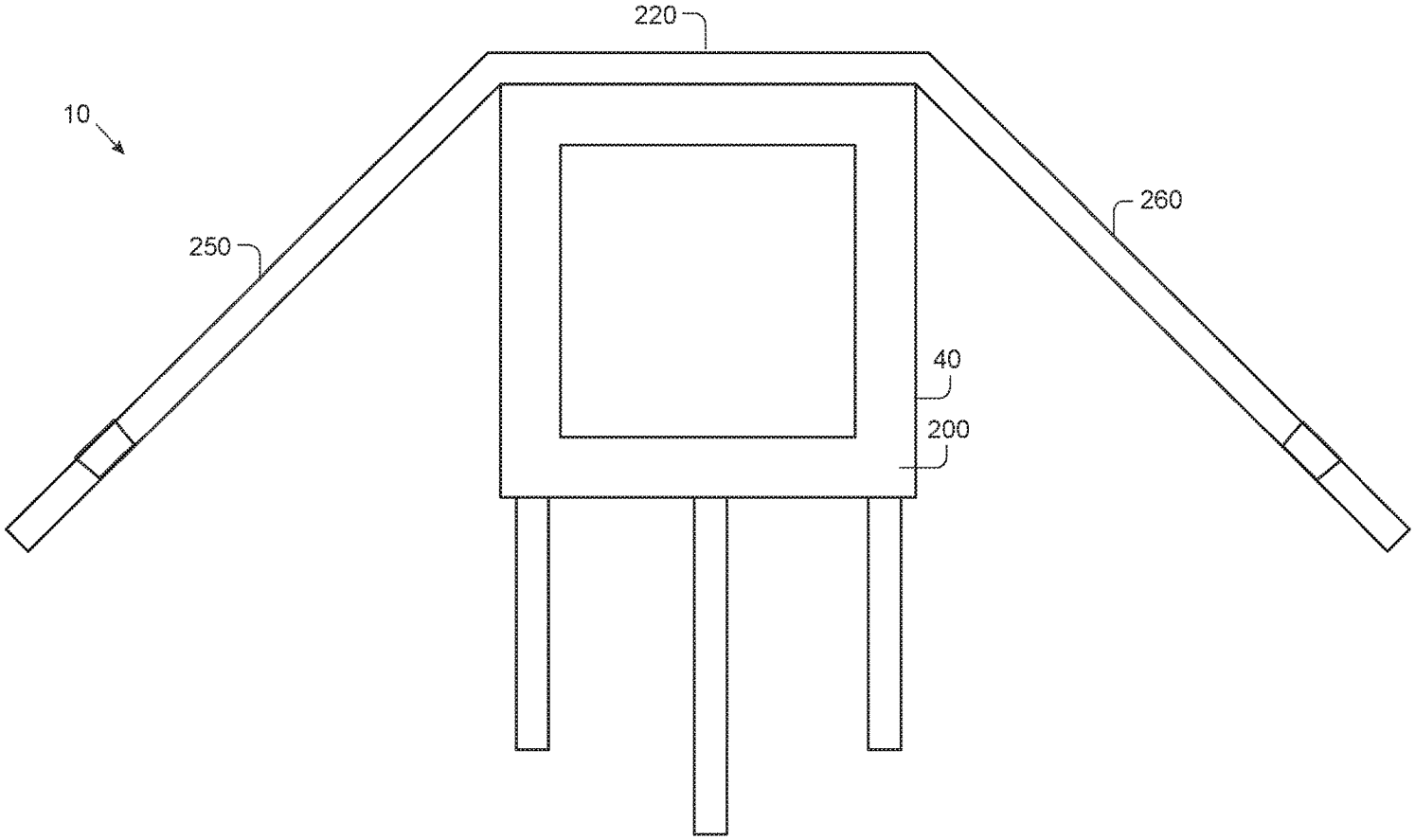
FIG. 10 is a general pictorial illustration of a preferred embodiment in accordance with the invention depicting a top of a post with a different bracket than FIG. 9.

Brace 50 may have turnbuckle 340 removed for storage in channel and or cavity 130, post 40 interior and so forth. Storage position 350 is generally depicted in FIG. 5 as opposed to deployed position 360 as depicted in FIG. 4. After the removal and or shortening of turnbuckle 340, brace 50 may be folded into cavity 130 wherein after post 40 may be folded into cavity 130 also. It is understood that adjustable length 320 may be another type of threaded device providing extension and contraction other than a turnbuckle 340.

It is understood that numerous types of fence panel sections 210 are contemplated such as those made from metal, wood, plastic, wire, combinations thereof and so forth. Numerous sizes and styles may be utilized also. In a preferred embodiment, "AMERISTAR MONTAGE PLUS 8' Panel 3-Rail with Invincible Picket" may be utilized as generally depicted.

In Operation

Figure 3:
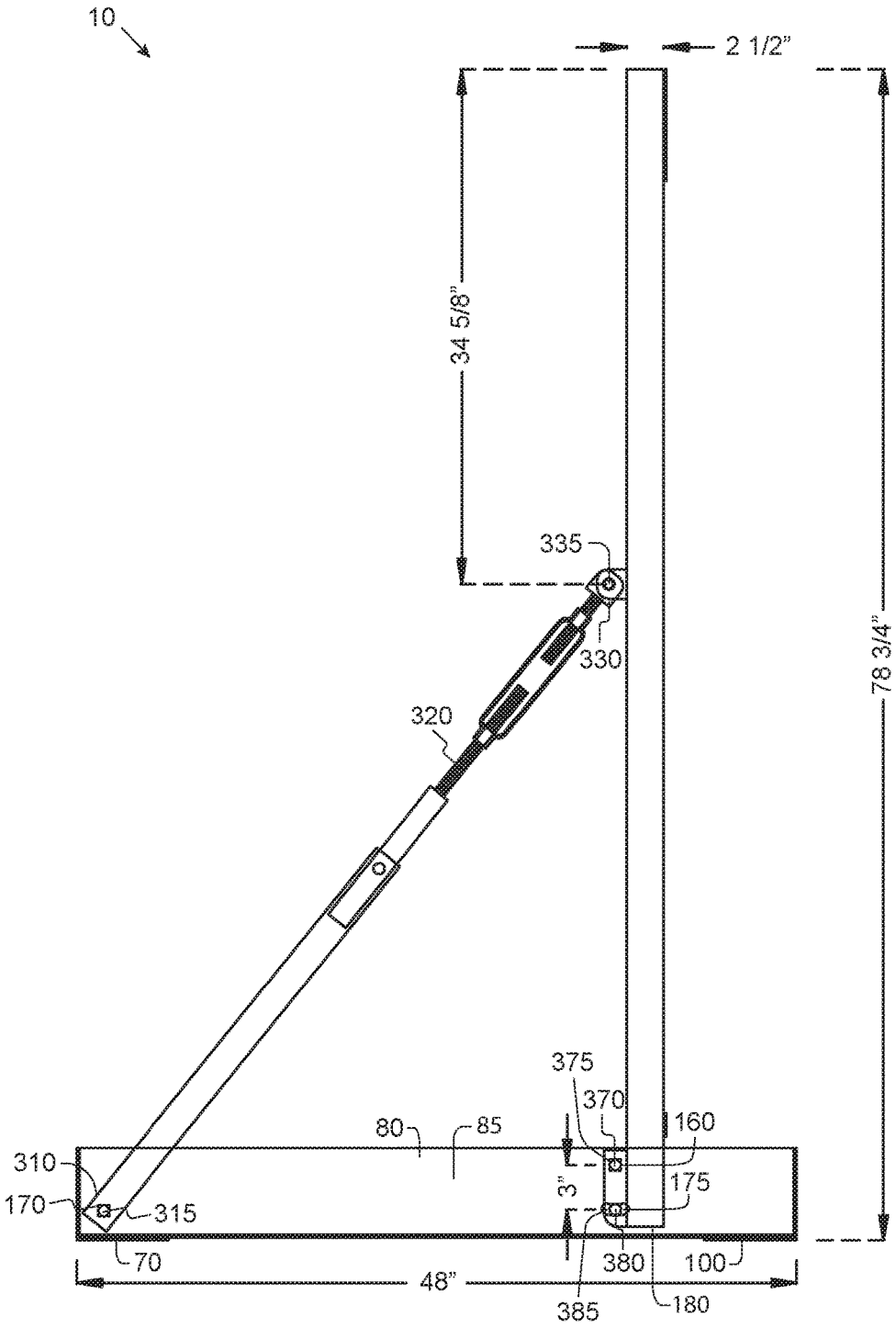
FIG. 3 is a general illustration of a preferred embodiment in accordance with the invention depicting another deployed post system with a different configuration than FIG. 2.
Figure 11:
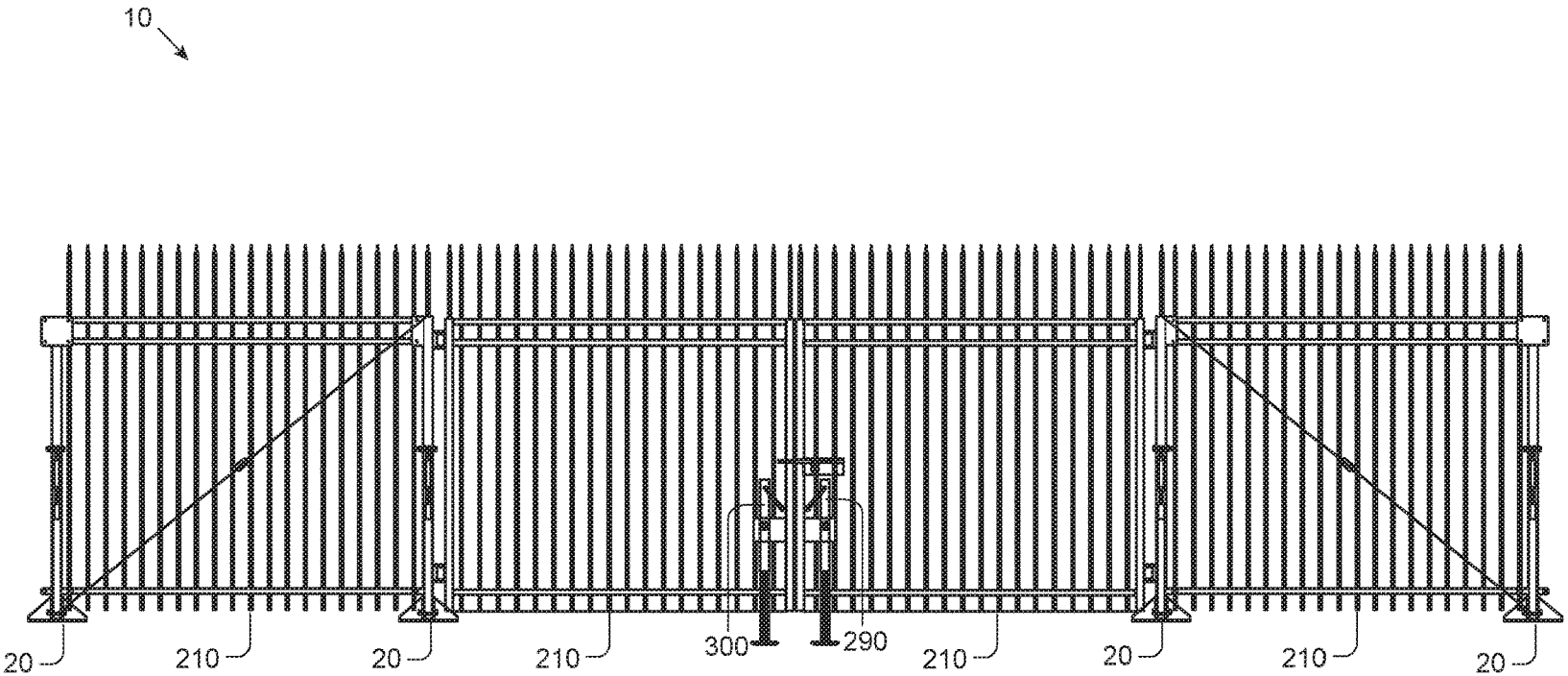
FIG. 11 is a general pictorial illustration of a preferred embodiment in accordance with the invention depicting a completed side of a fenced structure.
Figure 12:
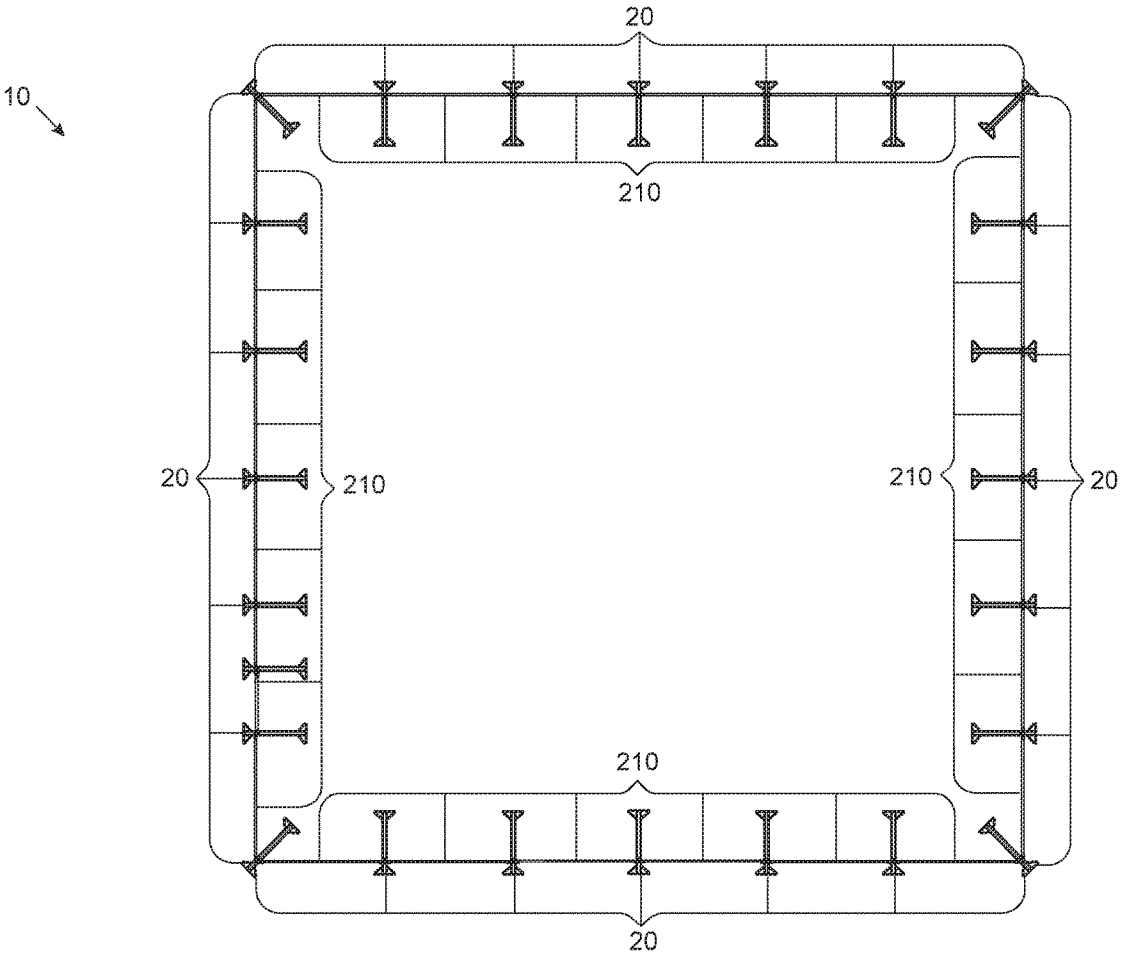
FIG. 12 is a general pictorial illustration of a preferred embodiment in accordance with the invention depicting a top view of a completed fence system.

Referring again to the illustrations and more in particular to FIGS. 11 and 12, invention 10 contemplates taking post system 20 and laying out in corresponding intervals to fence panel 210 dimensions to be utilized. Referring now to FIGS. 2 and 3, post 40 may be lifted from base 30 on a hinge bolt 370 through aperture 375 on post 40 and secured with the set bolt 380 through aperture 385 on post 40. Brace 50 is then lifted from base 30 with turnbuckle 340 assembly pulled from stored location within the brace 50 cavity 130. Turnbuckle 340 may be bolted to brace 50 then to post 40.

Turnbuckle 340 may then be adjusted up/down until post 40 is plumb or as desired with a slope in either direction. In a preferred embodiment, slope should not exceed 10 degrees. Once posts 40 are plumb, fence panels 210 can be installed using brackets 220 bolted to post 40 to meet the specified rail dimensions of the desired fence panels 210. It may then be time to make straight line and plumb adjustments prior to tightening of bolts. Further, the next step may be attaching gate panels and gate/corner tension cables.

Invention 10 provides a portable secure fence system. It may be disassembled in reverse method. It is contemplated that no special tools are required and assembly may be completed with just wrenches and bolts.

Invention 10 contemplates a non-ground penetrating portable fence post system comprising: a base having a first end, a length having a channel along said length and a midpoint, a second end, a first side, a second side, a bottom side, a first stabilization plate mounted on said bottom side at said first end of said base, a second stabilization plate mounted on said bottom side at said second end of said base, a pivot with an axis between said first side and said second side and parallel to said bottom side wherein said pivot is located between said base second end and said midpoint of said length; a post having a top end, a length with an axis along said length, a bottom end, at least one bracket adapted to attach a fence panel to said length, and wherein said bottom end is adapted to pivotally connect to said pivot of said base; and a brace having a first end pivotally attached to said first end of said base, a second end pivotally attached to said post, and a length adapted to be threadably adjustable wherein turning a first direction makes said length longer and turning in a second direction makes said length shorter.

A number of implementations have been described herein. Nevertheless, it will be understood that various modifications may be made. Accordingly, other implementations are within the scope of the following claims. Changes may be made in the combinations, operations, and arrangements of the various parts, elements, and amounts described herein without departing from the spirit and scope of the invention.

What is claimed is:

1. A non-ground penetrating portable fence post system comprising:

a base having a first end, a length having a channel along and on top of said length and a midpoint, a second end, a first side, a second side, a bottom side, a first non-ground penetrating stabilization plate mounted perpendicularly relative to said length on said bottom side at said first end of said base, a second non-ground penetrating stabilization plate mounted perpendicularly relative to said length on said bottom side at said second end of said base, a pivot pin and a set pin located in said channel with a first axis and a second axis respectively between said first side and said second side and parallel to said bottom side wherein said pivot and said set pin are respectively located between said base second end and said midpoint of said length;

a post having a top end, a length with an axis along said length, a bottom one-third portion of said length, a bottom end, at least one bracket adapted to attach a fence panel to said length, wherein said bottom end is adapted to pivotally connect to said pivot pin and said set pin of said base for positioning said post to less than 90 degrees or greater than 90 degrees relative to said base, wherein said post pivots around said pivot pin and said set pin secures said post in a desired position, and wherein said bottom end is received in said channel of said base; and a brace having a first end pivotally attached to said first end of said base, a second end pivotally attached to said bottom one-third portion of said length of said post, and a length adapted to be threadably adjustable wherein turning a first direction makes said length longer and turning in a second direction makes said length shorter.

* * * * *